US007782261B2

(12) United States Patent
An et al.

(10) Patent No.: US 7,782,261 B2
(45) Date of Patent: Aug. 24, 2010

(54) ANTENNA ARRANGEMENT

(75) Inventors: Rongbang-Thomas An, Beijing (CN); Lu Youyuan, Beijing (CN); Liu Shu, Beijing (CN)

(73) Assignee: Nokia Corporation, Espoo (FI)

( * ) Notice: Subject to any disclaimer, the term of this patent is extended or adjusted under 35 U.S.C. 154(b) by 339 days.

(21) Appl. No.: 11/642,342

(22) Filed: Dec. 20, 2006

(65) Prior Publication Data

US 2008/0150828 A1 Jun. 26, 2008

(51) Int. Cl.
*H01Q 1/24* (2006.01)

(52) U.S. Cl. ..... 343/702; 343/860

(58) Field of Classification Search ..... 343/702
See application file for complete search history.

(56) References Cited

U.S. PATENT DOCUMENTS

| | | | | |
|---|---|---|---|---|
| 6,011,518 | A * | 1/2000 | Yamagishi et al. | 343/713 |
| 6,147,652 | A * | 11/2000 | Sekine | 343/702 |
| 6,307,525 | B1 | 10/2001 | Bateman et al. | 343/853 |
| 6,774,850 | B2 * | 8/2004 | Chen | 343/700 MS |
| 2002/0118075 | A1 * | 8/2002 | Ohwada et al. | 333/32 |
| 2003/0142022 | A1 | 7/2003 | Ollikainen et al. | 343/702 |
| 2004/0075614 | A1 | 4/2004 | Dakeya et al. | 343/745 |
| 2005/0190107 | A1 * | 9/2005 | Takagi et al. | 343/702 |
| 2006/0176226 | A1 * | 8/2006 | Moon et al. | 343/702 |
| 2007/0099589 | A1 | 5/2007 | Kawai | 455/269 |
| 2008/0055173 | A1 | 3/2008 | Chominski | 343/741 |
| 2008/0252536 | A1 * | 10/2008 | Anguera et al. | 343/702 |

FOREIGN PATENT DOCUMENTS

| | | |
|---|---|---|
| EP | 0 469 779 A2 | 2/1992 |
| EP | 0 821 429 A2 | 1/1998 |
| EP | 1 720 216 A1 | 11/2006 |

OTHER PUBLICATIONS

Matthae, G.; Young. L.; Jones, E M. T. "Microwave Filters, Impedance-Matching Networks, and Coupling Structures", pp. 681-713, McGraw-Hill 1964, pp. 681-713.

Wagner, R., "Double Stub Matching" , pp. 1-8, Aug. 14, 2007, Retrieve from internet (Sep. 30, 2009) URL: http://cnx.org/content/m1066/latest/, Fig. 1; pp. 1-8.

* cited by examiner

*Primary Examiner*—Trinh V Dinh
(74) *Attorney, Agent, or Firm*—Harrington & Smith

(57) ABSTRACT

An antenna arrangement including a first antenna element having a first feed for connection to radio frequency circuitry; and a second antenna element, separate to the first antenna element, having a second feed connected to the first feed.

22 Claims, 3 Drawing Sheets

ANTENNA ARRANGEMENT

FIELD OF THE INVENTION

Embodiments of the present invention relate to an antenna arrangement. In particular, they relate to a low-profile antenna arrangement.

BACKGROUND TO THE INVENTION

It is generally desirable to make radio frequency technology more compact so that the devices carrying the technology can be made smaller or so that the technology can be integrated into devices that at present do not include the technology.

One problem associated with radio frequency technology is that at least one antenna element is required to be able to transmit radio frequency signals and to receive radio frequency signals. It is a difficult problem to design a radio frequency antenna element that has an acceptable efficiency in a frequency band of interest and which is also of a small size.

Performance of an antenna element is dependent upon the size of the antenna element as there is generally a relationship between the physical size of the antenna element and it's electrical length and also a relationship between the electrical length of the antenna element and it's resonant modes.

Furthermore, the size of a separation of an antenna element from other conducting components such as a ground plane or Printed Wiring Board can dramatically affect the performance of an antenna element. An antenna element may therefore need to be separated from a Printed Wiring Board by some distance to achieve acceptable performance. This places a constraint on the minimum size of a device that can house the antenna element and Printed Wiring Board.

BRIEF DESCRIPTION OF THE INVENTION

According to one embodiment of the invention there is provided an antenna arrangement comprising: a first antenna element having a first feed for connection to radio frequency circuitry; and a second antenna element, separate to the first antenna element, having a second feed connected to the first feed.

This provides the advantage that the antenna arrangement can have a wider bandwidth and higher efficiency with lower profile.

There is freedom to tune the antenna arrangement's impedance. In particular, the operational characteristics of the second antenna element and the second feed may be used to adapt the operational characteristics of the first antenna element. The second feed may be a transmission line.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
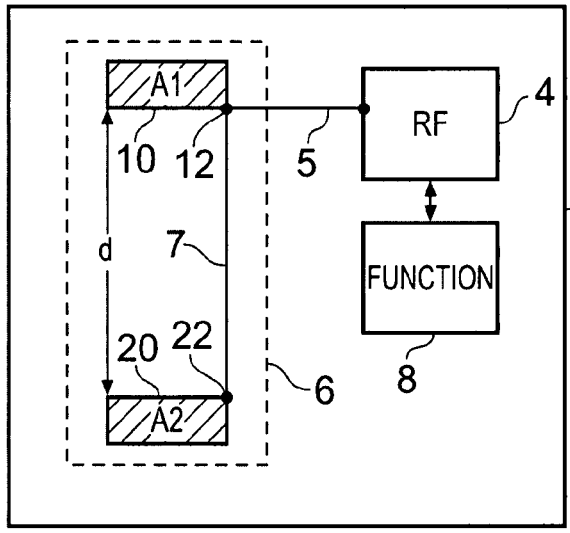
FIG. 1 schematically illustrates an apparatus that is suitable for radio communications.
Figure 2A:
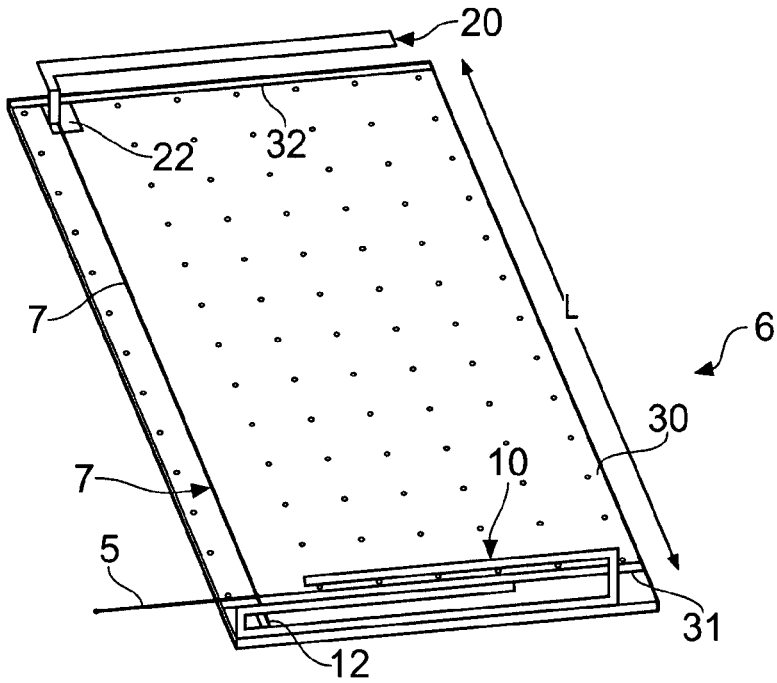
FIGS. 2A and 2B illustrate one implementation of the antenna arrangement.
Figure 2B:
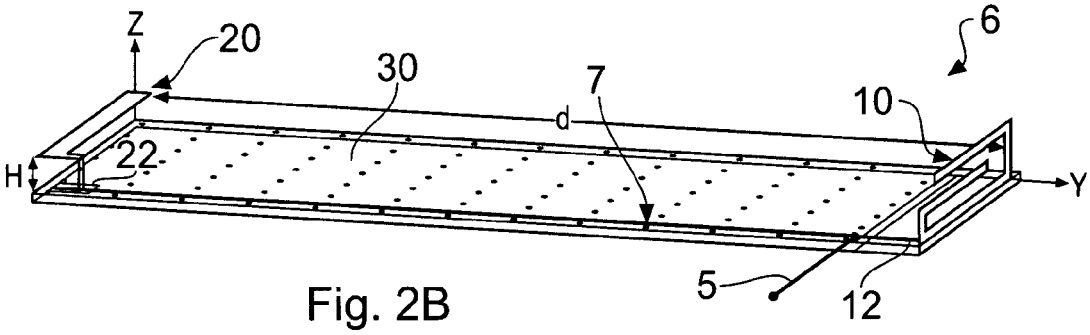

FIGS. 1, 2*a* and 2*b* illustrate an antenna arrangement 6 comprising: a first antenna element 10 having a first feed 12 for connection to radio frequency circuitry 4; and a second antenna element 20, separate to the first antenna element 10, having a second feed 22 connected to the first feed 12.

In more detail, FIG. 1 schematically illustrates an apparatus 2 that is suitable for radio communications using radio frequency (RF) technology. The apparatus 2 in this example, comprises functional circuitry 8 which provides data to RF circuitry 4 and/or receives data from RF circuitry 4 and an antenna arrangement 6 connected to the RF circuitry 4. The antenna arrangement 6 may be used to transmit RF signals provided by the RF circuitry 4 and/or receive RF signals that are provided to the RF circuitry 4.

The apparatus 2 may be any suitable device such as network equipment or portable electronic devices like a mobile terminal in a cellular communications network or, a hand-portable device such as a mobile cellular telephone, personal digital assistant, gaming device, music player, personal computer, that enables the device to communicate using RF technology.

Although in the following paragraphs, the RF technology is described in relation to a mobile cellular terminal for use in a cellular communications network, embodiments of the invention may find application in other RF networks such as local ad-hoc RF networks, infrastructure networks etc.

The RF circuitry 4 has an output 5 that is connected to a first feed 12 of the first antenna element 10. If the RF circuitry 4 is capable of transmitting, then the output 5 is typically connected to a power amplifier within the RF circuitry 4.

The first feed 12 of the first antenna element 10 is serially connected via transmission line 7 to a feed 22 of the second antenna element 20.

The second antenna element 20 is therefore indirectly fed via the first feed 12 of the first antenna element 10.

The transmission line 7 may be formed from many suitable materials or components. It may be, for example, coaxial cable, a microstrip, a stripline or even some ceramic component.

Figure 4:
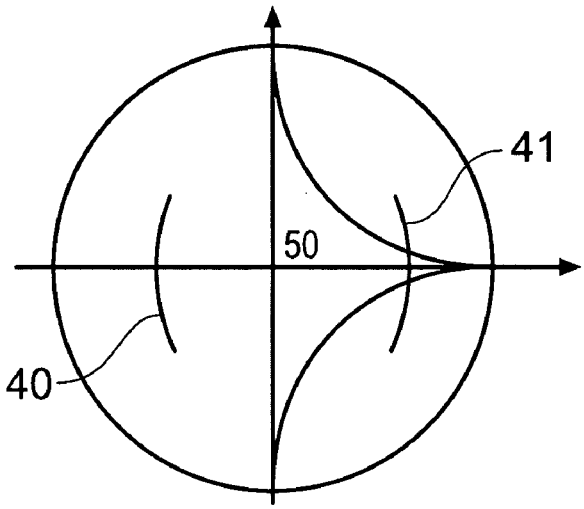
FIG. 4 schematically illustrates a Smith Chart.

The first antenna element 10 and the second antenna element 20 are distinct antenna elements that are separated by a distance d. This distance d is typically chosen to introduce a particular phase delay and shift one antenna's impedance relative to the other. Referring to FIG. 4, which schematically illustrates a Smith Chart, the distance d is chosen such that the first antenna element 10 has an first impedance curve 40 in the Smith Chart and the second antenna element 20 has a second impedance curve 41 on the Smith Chart that is in an opposite position to the first impedance curve 40.

Figure 5A:
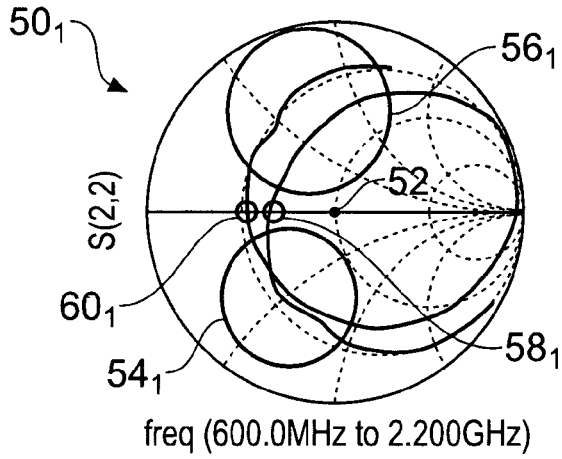
FIGS. 5A, 5B and 5C illustrate Smith Charts for, respectively, the first antenna element, the combination of the second feed and the second antenna element and the combination of the first antenna element, the second feed and the second antenna element.

In more detail, FIG. 5A schematically illustrates a Smith Chart $\mathbf{50}_1$ for the first antenna element 10. The Smith Chart illustrates that the first antenna element has a low band resonant frequency $\mathbf{58}_1$ and a high band resonant frequency $\mathbf{60}_1$. The lower frequency end $\mathbf{54}_1$ of the low band resonance and of the high band resonance need to be rotated in a clockwise direction within the Smith Chart for impedance matching. This may be achieved using a shunt inductor. The higher frequency end $\mathbf{56}_1$ of the low band resonance and of the high band resonance need to be rotated in a counter-clockwise direction within the Smith Chart for impedance matching. This may be achieved using a shunt capacitor.

Figure 5B:
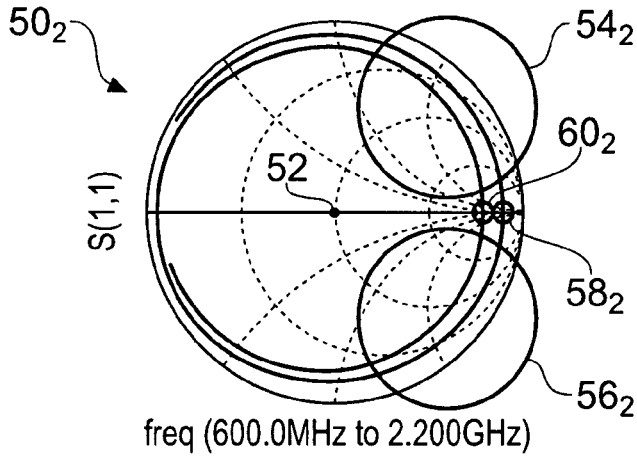

The required shunt inductor for the lower frequency end $54_1$ of the low band resonance and of the high band resonance is provided by the combination of transmission line 7 and second antenna element 20, the impedance of which is plotted as a Smith Chart in FIG. 5B.

The required shunt capacitor for the higher frequency end $56_1$ of the low band resonance and of the high band resonance is provided by the combination of transmission line 7 and second antenna element 20, the impedance of which is plotted as a Smith Chart in FIG. 5B.

FIG. 5B schematically illustrates a Smith Chart $50_2$ for the combination of the transmission line 7 and the second antenna element 20. The transmission line rotates the impedance of the second antenna element as seen in the Figure. The Smith Chart illustrates that the combination has a low band resonant frequency $58_2$ and a high band resonant frequency $60_2$. The lower frequency end $54_2$ of the low band resonance and of the high band resonance provide the required shunt inductance described above. The higher frequency end $56_2$ of the low band resonance and of the high band resonance provide the required shunt capacitance described above.

Figure 5C:
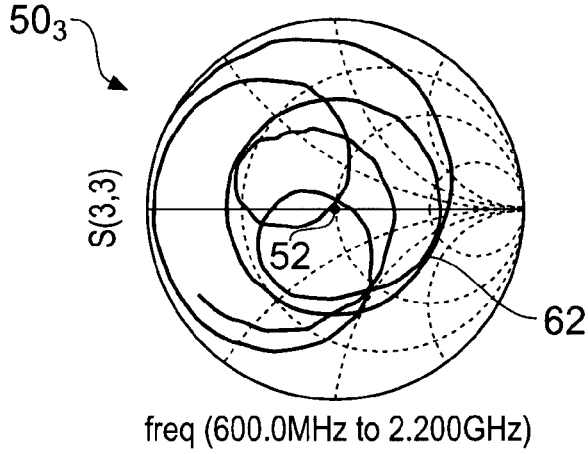

FIG. 5C schematically illustrates a Smith Chart $50_2$ for the combination of the first antenna element 10, transmission line 7 and the second antenna element 20 as viewed from the feed 5. It can be observed that the impedance for the whole of the low band and the high band is within a fixed voltage standing wave ratio (VSWR) represented by circle 62.

It should be appreciated that the second antenna element 20 operates as a frequency dependent load on the first antenna element 10 and operates as a matching network by compensating for variations in the impedance of the first antenna element.

In some embodiments, the required phase delay may be introduced using lumped components instead of the transmission line 7. In these embodiments, the first and second antenna elements may be located adjacent one another.

FIGS. 2A and 2B illustrate one implementation of the antenna arrangement 6 described in relation to FIG. 1. FIG. 2A is a top-front perspective view of the antenna arrangement 6 for a mobile cellular telecommunications terminal and FIG. 2B is a top left perspective view of the same antenna arrangement 6.

The antenna arrangement 6, as in FIG. 1, comprises distinct and separate first and second antenna elements 10, 20 in which the first feed 12 of the first antenna element 10 is fed directly by the output 5 of the RF circuitry 4 and the feed 22 of the second antenna element 20 is fed indirectly via the transmission line 7 connected to the first feed 12 of the first antenna element 10. Like references are used to denote like features in FIGS. 1, 2A, 2B.

In the embodiment of FIGS. 2A and 2B, the first antenna element 10 is a monopole antenna element and the second antenna element is an inverted L antenna element.

In the example illustrated in FIGS. 2A and 2B, the second antenna element 20 is positioned with a separation H from a ground plane 30; wherein, in an embodiment, H represents a displacement perpendicular to the plane of the ground plane 30 of less than 5 mm. The ground plane may be provided by, for example, a Printing Wiring Board.

The ground plane 30, in this example, is a substantially rectangular shape having a first edge 31 and a second opposing edge 32 that is substantially parallel to the first edge 31 and separated there from by a distance L.

The first antenna element 10 and the second antenna element 20 are positioned so that they have maximum relative displacement. The first antenna element 10 is positioned adjacent the first edge 31 of the ground plane 30 and the second antenna element 20 is positioned adjacent the second edge 32 of the ground plane 30.

The separation H of the second antenna element 20 from the ground plane 30 is small as a consequence of the antenna arrangement 6. In particular, the serial connection of the second antenna element 20 to the feed 12 of the first antenna element 10 loads the first antenna element 10 and improves it's operational characteristics, therefore allowing some of this improvement to be sacrificed to a reduction in the profile of the second antenna element 20.

The first antenna element 10 and the second antenna element 20 in the embodiment illustrated in FIGS. 2A and 2B are separated by a distance of tens of millimeters. For example the length L of the ground plane 30 may be over 90 millimeters in length.

Typically the ILA antenna element 20 has a low height above the ground plane e.g. less than 4 mm and the monopole antenna element 10 does not require a ground plane and therefore requires little height for use e.g. 8 mm.

Figure 3:
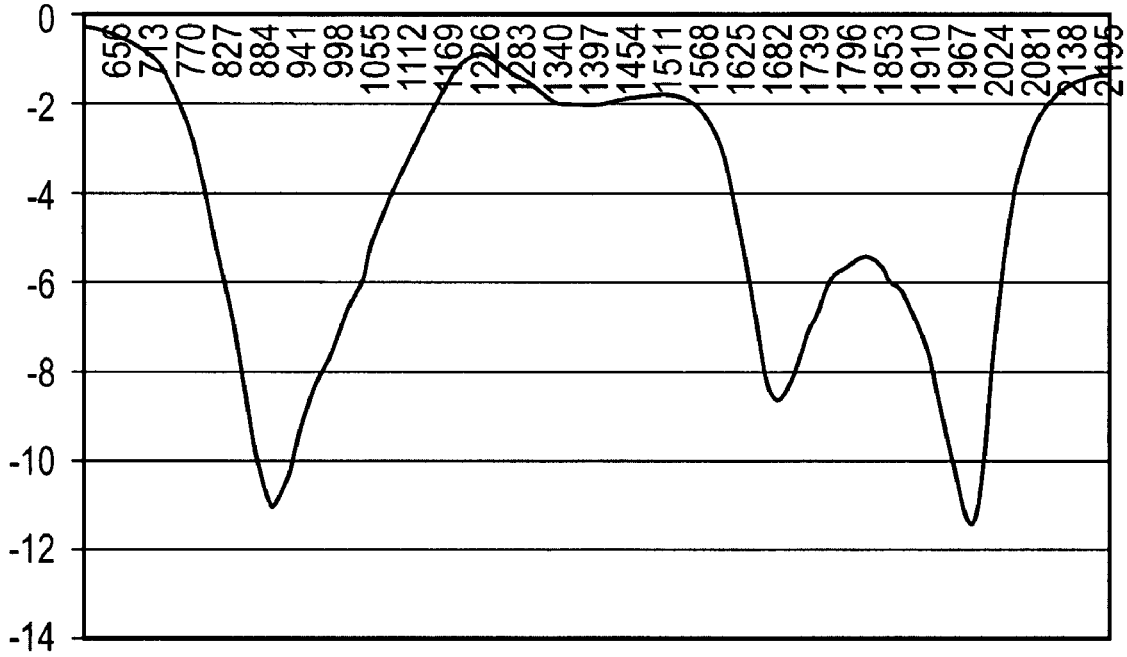
FIG. 3 is a schematic illustration of the return loss S11 of the antenna arrangement of FIGS. 2A and 2B.

A schematic illustration of the return loss S11 of the antenna arrangement 6 of FIGS. 2A and 2B is illustrated in FIG. 3. The antenna arrangement 6 is a dual resonance structure with a broad bandwidth low band that covers the US-GSM850 band (824-894 MHz) and the EGSM 900 band (880-960 MHZ). It also has a wide bandwidth at higher frequencies covering for example one or more of the following mobile cellular telecommunication bands: PCN/DCS1800 (1710-1880 MHZ), US-WCDMA1900 (1850-1990 MHZ), PCS1900 (1850-1990 MHZ). In other implementations it may also or alternatively cover the WCDMA2100 band (TX-1920-1980, RX-2110-2180).

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An antenna arrangement comprising: a first antenna element having a first low band resonant frequency, a first high band resonant frequency, and a first feed for connection to radio frequency circuitry; and a second antenna element, separate to the first antenna element, having a second feed, wherein the second antenna element and the second feed, in combination, have a second low band resonant frequency and a second high band resonant frequency, wherein the second feed is connected to the first feed at the first antenna element, wherein the second feed comprises a phase delay element, wherein the second antenna element loads the first antenna element to provide multi-band resonant frequency operation, wherein the first and second feeds are configured to receive a common frequency band.

2. The antenna arrangement as claimed in claim 1, further comprising a ground plane associated with at least the first antenna element.

3. The antenna arrangement as claimed in claim 2, wherein the first antenna element is positioned perpendicularly from the ground plane with a height of less than 8 mm above the ground plane.

4. The antenna arrangement as claimed in claim 2, wherein the ground plane has first and second opposing edges and the first and second antenna elements are located at the respective first and second opposing edges.

5. The antenna arrangement as claimed in claim 4, wherein the first antenna element is positioned perpendicular to a plane of the ground plane with a height of less than 8 mm above the ground plane.

6. The antenna arrangement as claimed in claim 5, wherein the ground plane is a printed wiring board.

7. The antenna arrangement as claimed in claim 1, wherein the first antenna element is an inverted L antenna.

8. The antenna arrangement as claimed in claim 7, wherein the second antenna element is a monopole.

9. The antenna arrangement as claimed in claim 1, wherein the first antenna element is a monopole.

10. The antenna arrangement as claimed in claim 1, wherein the second antenna operates as part of a matching network for the first antenna element that compensates for changes in the impedance of the first antenna element.

11. The antenna arrangement as claimed in claim 1, wherein the antenna arrangement comprises a dual resonant structure with a broadband bandwidth low band and a wide bandwidth at higher frequencies wherein operational characteristics of the second antenna element and the second feed are used to adapt operational characteristics of the first antenna element, the dual resonant structure comprising the first and second antenna elements.

12. The antenna arrangement of claim 1, wherein the phase delay element is a transmission line.

13. The antenna arrangement of claim 1, wherein the phase delay element is a lumped component.

14. An antenna arrangement comprising: a first antenna element having a first low band resonant frequency, a first high band resonant frequency, and a first feed for connection to radio frequency circuitry; a second antenna element, separate to the first antenna element, having a second feed serially connected to the first feed via a phase delay element, wherein the second antenna element and the second feed, in combination, have a second low band resonant frequency and a second high band resonant frequency, wherein the second feed is connected to the first feed at the first antenna element; and a ground plane associated with at least the first antenna element, wherein the ground plane is a printed wiring board, wherein the first antenna element and the second antenna element are disposed at opposing edges of the printed wiring board and the second feed comprises a transmission line spanning the opposing edges so as to electrically connect the first and second antenna elements.

15. The antenna arrangement as claimed in claim 14, wherein the second antenna element is a load of the first antenna element.

16. The antenna arrangement as claimed in claim 14, wherein the second antenna operates as part of a matching network for the first antenna element that compensates for changes in the impedance of the first antenna element.

17. The antenna arrangement as claimed in claim 14, wherein the second feed comprises a lumped circuit.

18. An apparatus comprising: radio frequency circuitry and an antenna arrangement comprising: a first antenna element having a first low band resonant frequency, a first high band resonant frequency, and a first feed for connection to the radio frequency circuitry; and a second antenna element, separate to the first antenna element, having a second feed, wherein the second antenna element and the second feed, in combination, have a second low band resonant frequency and a second high band resonant frequency, wherein the second feed is connected to the first feed at the first antenna element, wherein the second feed comprises a phase delay element, wherein the second antenna element loads the first antenna element to provide multi-band resonant frequency operation, wherein the first and second feeds are configured to receive a common frequency band.

19. The apparatus of claim 18, wherein the apparatus is a portable electronic device.

20. The apparatus of claim 19, further comprising a ground plane associated with at least the first antenna element, wherein the ground plane is a printed wiring board.

21. The apparatus of claim 18, wherein the phase delay element is a transmission line.

22. The apparatus of claim 18, wherein the phase delay element is a lumped component.

* * * * *